United States Patent [19]

Wolff

[11] Patent Number: 4,492,544

[45] Date of Patent: Jan. 8, 1985

[54] GEAR MACHINE WITH DISPLACEABLE CENTRAL HOUSING PART

[75] Inventor: Günter Wolff, Schwieberdingen, Fed. Rep. of Germany

[73] Assignee: Robert Bosch GmbH, Stuttgart, Fed. Rep. of Germany

[21] Appl. No.: 344,777

[22] Filed: Feb. 1, 1982

[30] Foreign Application Priority Data

Mar. 28, 1981 [DE] Fed. Rep. of Germany ..... 3112470

[51] Int. Cl.[3] ..... F04C 27/00

[52] U.S. Cl. ..... 418/107; 418/206

[58] Field of Search ..... 418/107, 108, 109, 125, 418/126, 206, 71, 73

[56] References Cited

U.S. PATENT DOCUMENTS

| | | | |
|---|---|---|---|
| 2,691,945 | 10/1954 | Wichorek | 418/108 |
| 2,742,862 | 4/1956 | Banker | 418/126 |
| 3,472,170 | 10/1969 | Eckerle | 418/126 |
| 3,512,906 | 5/1970 | Molly | 418/107 |
| 3,525,579 | 8/1970 | Cygnor | 418/107 |
| 3,986,800 | 10/1976 | Dworak | 418/126 |
| 4,266,915 | 5/1981 | McBurnett | 418/126 |
| 4,334,840 | 6/1982 | Teruyama | 418/179 |

*Primary Examiner*—Leonard E. Smith
*Assistant Examiner*—Jane E. Obee
*Attorney, Agent, or Firm*—Michael J. Striker

[57] ABSTRACT

A gear machine has a housing with a sealing recess and a sealing region, two gear members engaging with one another and arranged so that after mounting of the machine the gear members penetrate into a material removing manner into the sealing region of the housing for sealing purposes, and an element for urging the gear members and the sealing region of the housing to contact with one another prior to a material removal from the housing.

10 Claims, 2 Drawing Figures

GEAR MACHINE WITH DISPLACEABLE CENTRAL HOUSING PART

BACKGROUND OF THE INVENTION

The present invention relates to a gear machine such as a gear pump or a gear motor.

Gear pumps and motors are known and widely utilized. For a high volumetric efficiency of such machines it is important that the gears not only abut with their flat sides tightly against the surrounding housing walls, but also at their end sides. For this purpose the bearing or supporting members of the gears are so designed and arranged that the gears are worked in (with cutting into of the housing) with their end sides into the housing recess at the low pressure side of the machine under the action of the pressure at the high pressure side of the machine, so as to provide for a material removal. Thereby a high tightness between the high pressure side and the low pressure side along the outer circumference of the gears is attained. It is, however, difficult to arrange the gears prior to the cutting so that they tightly abut against the subsequent sealing agent of the housing recess. For attaining this, it is necessary to exactly align the housing parts and connect them with each other, which operations are very expensive in mass-production of the gear machines.

SUMMARY OF THE INVENTION

Accordingly, it is an object of the present invention to provide a gear machine which avoids the disadvantages of the prior art.

More particularly, it is an object of the present invention to provide a gear machine in which the exact alignment of parts of the housing prior to cutting into the housing is not necessary or is attained automatically, so that the mounting is extremely simplified.

In keeping with these objects and with others which will become apparent hereinafter, one feature of the present invention resides, briefly stated, in a gear machine which has a housing with a receiving recess and a sealing region, two gear members engaging with one another and arranged so that after mounting of the machine the gear members penetrate into a material removing manner into the sealing region of the housing for sealing purposes, wherein means is provided for urging of the gear members and the housing sealing region to contact with one another prior to a material removal from the housing.

When the gear machine is designed in accordance with the present invention, it is not necessary to exactly align the parts of the housing relative to one another, and such an alignment is carried out automatically, which simplifies the mounting of the gear machine.

The urging means urge the gear members and the housing parts to contact with one another. An unobjectionable cutting into the housing by the gear members can also be performed when the gear shafts are arranged not in radially movable bearing members, but instead in fixed bearings such as bearing bores formed in housing plates. A new cutting into the housing is possible without difficulty after long service life and dismounting of the machine.

The urging means is preferably formed as spring means. They can urge the housing parts toward the gear members, to the contrary, they can displace the gear members toward the sealing region of the housing.

In accordance with another feature of the present invention, the urging means can be arranged so that the material removal takes place at the low pressure side of the housing, or the material removal can take place at the high pressure side of the housing. The side of the material removal depends upon the arrangement and prestress of the spring means.

Still another feature of the present invention is that the urging means is formed as a prestressed springy pin. This springy pin can engage in two neighboring parts of the housing.

A further feature of the present invention is that the urging means is arranged so that its force transmitting direction extends substantially centrally of an imaginary straight line connecting the axes of the gear members, and act upon the housing. The urging means can act upon one of the housing parts movable to another housing part. More particularly, the urging means can act upon a central housing part located between two outer housing parts.

The urging means can be arranged so that they displace bearing members which support the shafts of the gear members.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
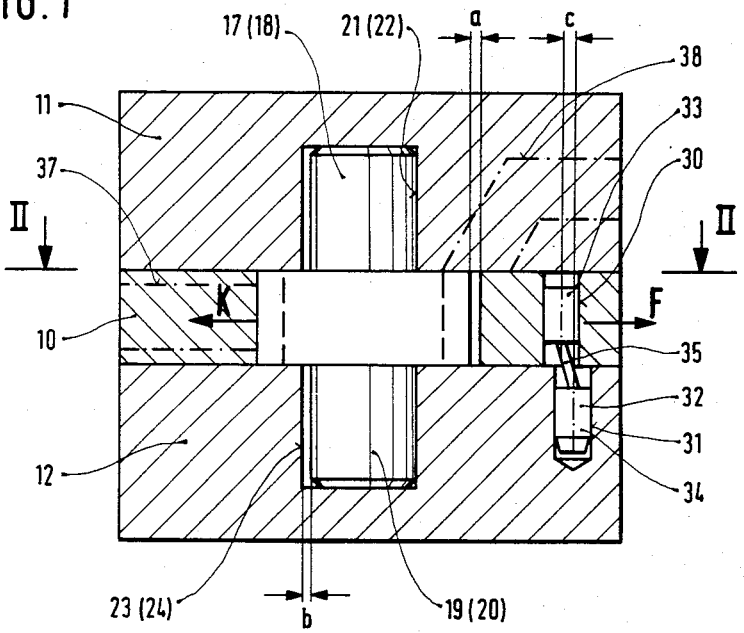
FIG. 1 is a view showing a section of a gear machine in accordance with the present invention taken along line I—I in FIG. 2.
Figure 2:
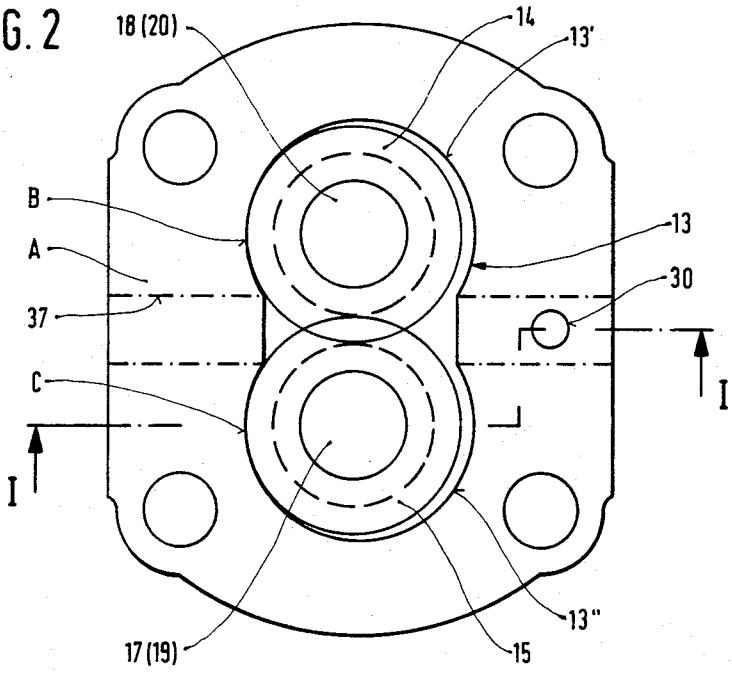
FIG. 2 is a view showing a section of the inventive gear machine, taken along the line II—II in FIG. 1.

A gear machine in accordance with the present invention has a housing which includes a central housing part 10 and two outer housing parts or covers 11 and 12 enclosing the central housing part 10.

The central housing part 10 is provided with a recess 13 composed of two undercut openings 13' and 13''. The housing parts are plate-shaped, and the thus-designed gear machine is formed as a so-called plate-assembled gear machine.

Two gear members 14 and 15 are arranged in the housing recess 13 and engage with one another. They are arranged with a radial play a whereas the side faces of the gear members border in a play-free manner on the covers 11 and 12. The gear members have shaft ends or trunions 17, 18 and 19, 20 which are received in openings 21, 22 or 23, 24 provided in the covers 11 or 12, respectively. The trunions are supported in the openings with a radial play b which is equal or smaller than the play a between the crown line or circle of the gears and the recess of the housing.

An opening 30 is provided in the central housing part 10 and extends in axial direction of the gears. A blind opening 31 is formed in the cover 12 and also extends parallel to the axes of the gear members. The opening 31 has a diameter substantially corresponding to the diameter of the opening 30, but is offset relative to the opening 30 by a distance c. The distance c substantially corresponds to the play b. The opening 31 is outwardly offset so that its central axis is farther from the axes of the gear shafts than the central axes of the opening 30.

A spring element 32 is inserted in the openings 30 and 31. The spring element 32 is composed, for example, of two cylindrical parts 33 and 34 which are received in the openings 30 and 31 and connected with one another by a springy central part 35. The central part 35 of the spring element 32 have a predetermined prestress so that it acts upon the central housing part 10 in such a manner that when the housing parts are not fixedly connected with one another, the central housing part 10 displaces relatively the covers 11 and 12 and abuts with its suction side part A against sealing regions B and C on the gear member end sides.

The suction side has an opening 37 which extends transverse to an imaginary straight line connecting the axes of the gear members with one another and opens into the recess 13 at one side of the housing. High pressure side is formed opposite to the suction side and has a passage 38 extending in a cover 11 and opening into the recess 13. The passage 38 is provided in the cover 11 because the central housing part 10 is formed with the opening 30 and the cover 12 is formed with the opening 31. The opening 30 is arranged in the center between the axes of the gear member, but is laterally offset relative to the same and in pressure-side region.

When the spring element is inserted and the housing parts are premounted, the central housing part 10 is displaced by the spring element 32, as mentioned above, so that the central housing part 10 abuts with its sealing region against the end side of the gear members 13 and 15. Then the housing parts are fixedly connected with one another, for example by screwing, and a pressure medium and a high pressure is applied via the passage 38. This applies a hydraulic pressure K upon the gear members in direction toward the low pressure side. For cutting into the housing, the gear members are slowly driven so that they somewhat penetrate under the action of the force K into the low pressure side sealing regions B and C. This is possible because of the play b between the gear shafts and the openings receiving the latter. Chips produced during the cutting are removed by the pressure medium flowing out via the passage 37. After a certain trueing time the trueing process finishes. The play a is required as a premounting tolerance.

It is to be understood that other spring elements different from that described are possible, such as for example a spiral tensioning pin, a synthetic plastic element, etc. Furthermore, the trunions of the gear members can be arranged in conventional bearing members which also have a radial play in openings receiving the same and can be displaced by the spring elements so as to press the gears, prior to the cutting step, against the low pressure side housing region.

It will be understood that each of the elements described above, or two or more together, may also find a useful application in other types of constructions differing from the types described above.

While the invention has been illustrated and described as embodied in a gear machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of the present invention.

What is claimed is:

1. A gear machine, comprising a housing having a receiving recess and a sealing region; two gear members engaging with one another and arranged so that after mounting of the machine said gear members penetrate in a material removing manner into said sealing region of said housing for sealing purposes; and spring means for urging said gear members and said sealing region of said housing to contact with one another prior to a material removal from said housing, said housing having a plurality of housing parts which together form said housing and include one housing part defined by two intersecting bores completely surrounding said gear members, said spring means being arranged to displace said one housing part toward and against said gear members.

2. A gear machine as defined in claim 1, wherein said housing forms a low pressure side and a high pressure side, said sealing region being provided at said low pressure side of said housing.

3. A gear machine as defined in claim 1, wherein said housing forms a low pressure side and a high pressure side, said gear members and said spring means being arranged so that the material removal takes place at the low pressure side of said housing.

4. A gear machine as defined in claim 1, wherein said spring means for urging said gear members and said sealing region of said housing to contact with one another includes a prestressed springy pin.

5. A gear machine as defined in claim 1, wherein said urging means is arranged so that its force transmitting direction extends substantially centrally of an imaginary straight line connecting the axes of said gear members and acts upon said one housing part.

6. A gear machine as defined in claim 1, wherein said displaceable one housing part is formed so that it performs housing functions for said gear members.

7. A gear machine as defined in claim 1, wherein said one housing part is a one-piece housing part, said spring means being arranged to displace said one-piece housing part.

8. A gear machine as defined in claim 1, wherein said one housing part is formed as a central housing part, said plurality of housing parts also including two outer housing parts which surround said central housing part and are also formed as one-piece housing parts.

9. A gear machine as defined in claim 1, wherein said plurality of housing parts include three housing parts with a central housing part which forms said one housing part, and with two outer housing parts surrounding the latter, said spring means being arranged to act upon said central housing part.

10. A gear machine as defined in claim 9, wherein said housing parts are plate-shaped so that the machine is formed as a plate gear machine, said gear members having shafts, and said outer housing parts having openings for receiving said shaft of said gear members.

* * * * *